US006105558A

United States Patent [19]

Bushling

[11] Patent Number: 6,105,558

[45] **Date of Patent: *Aug. 22, 2000**

[54] SUPERCHARGING APPARATUS

[76] Inventor: William Bushling, 6262 Newville Rd., Orland, Calif. 95963

[ * ] Notice: This patent is subject to a terminal disclaimer.

[21] Appl. No.: 08/440,445

[22] Filed: May 12, 1995

[51] Int. Cl.[7] ..... F02B 33/38

[52] U.S. Cl. ..... 123/559.1; 464/83

[58] Field of Search ..... 123/559.1; 464/83, 464/85, 160

[56] References Cited

U.S. PATENT DOCUMENTS

| | | | |
|---|---|---|---|
| 2,201,693 | 5/1940 | Heess et al. | 123/559.1 |
| 2,514,897 | 7/1950 | Paulsen | 464/83 |
| 3,195,324 | 7/1965 | Sellwood et al. | 464/83 |
| 3,427,827 | 2/1969 | Airheart | 464/83 |
| 4,844,044 | 7/1989 | McGovern | 123/559.1 |
| 5,263,463 | 11/1993 | Perry | 123/559.1 |

FOREIGN PATENT DOCUMENTS

| | | | |
|---|---|---|---|
| 139354 | 11/1934 | Austria | 123/559.1 |
| 864045 | 1/1941 | France | 123/559.1 |
| 928263 | 5/1955 | Germany | 123/559.1 |
| 281237 | 5/1928 | United Kingdom | 123/559.1 |
| 696729 | 9/1953 | United Kingdom | 123/559.1 |

*Primary Examiner*—Michael Koczo
*Attorney, Agent, or Firm*—Joseph E. Gerber

[57] ABSTRACT

A supercharger for a V-twin motorcycle engine comprised of a transmission portion and a blower portion is disclosed. A first embodiment includes a power take-off coupling having a drive gear rotationally engaged with a vertical drive shaft wherein the drive shaft is coupled to the blower's input drive via a pair of output drive ration selection gears. A second embodiment includes an alternative transmission structure wherein rotational transmission passes through a series of spur gears and a set of bevel gears. A set of quick-change gears to alter the gear ratio of the second embodiment is also disclosed.

3 Claims, 7 Drawing Sheets

SUPERCHARGING APPARATUS

Reference is hereby made to Disclosure Document Ser. No. 350,701 filed Mar. 24, 1994 for MAGNA CHARGER A gear-driven supercharger for a Harley-Davidson™ Big V-Twin.

BACKGROUND OF THE INVENTION

1. Field of the Invention

The present invention relates generally to supercharging apparatus for internal combustion engines, and more specifically relates to apparatus for supercharging V-twin motorcycle engines.

2. Description of the Related Art

In the art of internal combustion engines, supercharging is a well-known technique for boosting an engine's performance. Currently, superchargers are either standard or optional equipment on common, consumer versions of a wide variety of motor vehicles. However, supercharging apparatus is not yet widely used on engines of certain consumer versions of motorcycles, the most notable being Harley-Davidson® motorcycles, virtually all of which include that company's distinctive V-twin engine design.

Past applications of supercharger technology to Harley-Davidson® V-twin engines have been primarily in the high performance and custom styling segments of the industry. Attempts to develop a consumer-acceptable version of a supercharger for O.E.M. or retro-fit applications have largely failed due to several primary drawbacks in previously-promoted designs. These drawbacks include: the necessity of uncomfortable modification of the rider's seating and/or leg position; unsightly alteration of the motorcycle's appearance; unacceptable alteration of the sound of the motorcycle; excessive complexity of design, requiring belts, pulleys, cables, and the like, and the tedious and continuous maintenance that such mechanisms demand; unreliability and short service life; a level of installation and/or maintenance difficulty beyond the likely skill and tool availability of the common consumer; a lack of means for easy modification of the performance of the unit; and, unacceptably high purchase and replacement part prices, as well as high costs of repair. One example of a motorcycle supercharger having some of these problems is that shown in U.S. Pat. No. 5,263,462 issued to Perry in 1993.

Superchargers are generally comprised of two primary portions, the blower portion and the transmission portion (not to be confused with the transmission in a vehicle's primary drive train). The blower portion is the supercharger's air compressing apparatus. The transmission portion delivers rotation from a power take-off on the engine to the supercharger's blower portion. Many of the above-identified problems can be attributed directly to the design of the transmission portions of such motorcycle superchargers. Indeed, superchargers for other types of motor vehicles wherein belts, pulleys and the like are employed in the transmission portion of the unit also suffer similar problems with respect to complexity, cost, service life, and repair.

Accordingly, it appears that a need exists for a supercharger which is easy and inexpensive to install in both O.E.M. and retro-fit applications, and which has a long, low-maintenance service life. And, for application to V-twin engine-powered motorcycles such as those manufactured by Harley-Davidson®, it would be additionally beneficial if such a supercharger provided sufficient clearance for rider comfort, while not impairing two primary aesthetic features of which Harley-Davidson® owners are so fond, namely the motorcycle's sound and appearance. Yet further, it would be superiorly advantageous if such a supercharger were able to be easily modified to change its blower speed for higher performance applications.

SUMMARY OF THE INVENTION

The supercharging apparatus of the present invention is adapted to overcome the above-noted shortcomings and to fulfill the stated needs. As is common, it includes a blower portion and a transmission portion. The blower portion may be any one of a number of known types—two currently-marketed versions of positive displacement, Roots-type blowers being noted as preferred for V-twin motorcycle applications.

The transmission portion may be one of two primary configurations comprised of different combinations of elements, each combination being described and claimed herein. The first combination is comprised of first and second drive shafts, wherein the first drive shaft comprises a sleeve and drive gear coupled to any available power take-off on an engine, and wherein the second drive shaft is in rotational communication with the first drive shaft through a right-angled set of gears. An output drive gear is, at once, in rotational communication with the second drive shaft and with a supercharger's blower portion. Torsion dampening means is preferably disposed between the first and second drive shafts.

Elements in rotational communication with one another are not necessarily directly engaged. When, here and in the claims, elements are referred to as being in rotational communication with one another, that should be understood to mean that as one rotates, the other rotates. Where critical, attention must be paid to the direction of rotation that is transmitted from one element to another. Mechanical conventions apply. The second end of a shaft will rotate in the same direction as the shaft's first end. A second gear will rotate opposite to a first if they are directly engaged. Although here and in the claims, elements described as being in rotational communication with one another may have intervening elements disposed between them, when one rotates the other will rotate, as well. The ultimate resultant direction of rotation will depend upon the character of the intervening elements.

The second transmission portion combination is comprised of means for coupling an input drive gear to any available power take-off; an intermediate drive shaft in rotational communication with the first gear; and, an output drive gear in rotational communication with the intermediate drive shaft, wherein the output drive gear is also in rotational communication with a supercharger's blower portion.

It is an object of the present invention to provide a supercharger which is easy and inexpensive to install in both O.E.M. and retro-fit applications, and which has a long, low-maintenance service life.

It is a further object of the present invention to provide a supercharger which is superiorly adapted for use in combination with a V-twin motorcycle engine, and especially an engine of a Harley-Davidson® motorcycle.

Yet another object of this invention is to provide a motorcycle engine supercharger which can be mounted on either side of a motorcycle's engine.

Yet a further object of the present invention is to provide a motorcycle engine supercharger which does not interfere with a rider's leg or seating position, whether said supercharger is mounted on either side of the engine.

Still a further object of the present invention is to provide a transmission for a motorcycle engine supercharger which is easily mated with a wide variety of brands and types of blower units.

Another object of the present invention is to provide a motorcycle engine supercharger which is easily mated with various fuel atomizing mechanisms including single or multiple carburetors, and fuel injection, in both upstream and downstream applications.

Still further objects of the inventive supercharger embodiments disclosed herein will be apparent from the drawings and following detailed description thereof.

DESCRIPTION OF THE PREFERRED EMBODIMENTS

Figure 1:
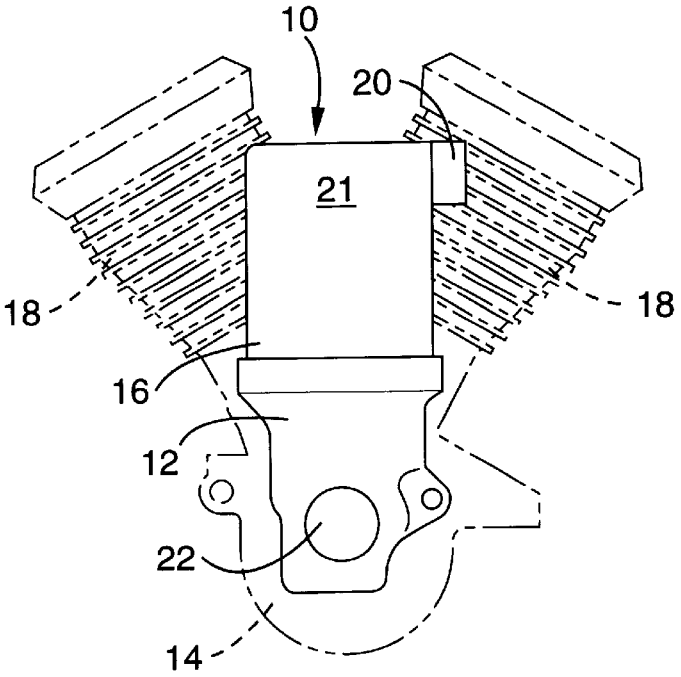
FIG. 1 is a side elevational view of a first embodiment of the supercharging apparatus of the invention, the transmission portion therein being mated with an Eaton blower unit.

Referring now specifically to the drawings, FIG. 1 shows a first preferred embodiment of the inventive supercharging apparatus, which is generally identified herein with the reference numeral 10. FIG. 1 illustrates the mounting orientation and general environment of supercharger 10 installed on the right side, i.e. the cam shaft side, of a V-twin motorcycle engine such as that generally used to power Harley-Davidson® motorcycles. Therein, the supercharger's transmission housing 12 is shown mated with the engine's crank case 14, replacing its standard-equipment side cover (not shown). And, the supercharger's blower housing 16 is shown atop transmission housing 12, positioned generally between cylinders 18. Blower housing 16's intake 20 may be coupled to one or more carburetors or, alternatively, fuel injection apparatus, neither of which is shown. Blower housing 16's output (not shown) is on its inside face, between cylinders 18, and is coupled with the engine's intake manifold (not shown).

The preferred blower unit is a positive displacement blower of the backflow, or Roots-type. And, the blower configuration shown in FIG. 1 is intended to depict a Roots-type blower unit currently manufactured by the Eaton Corporation. The Eaton blower unit is generally identified herein with reference numeral 21. However, it should be understood that the supercharger transmission disclosed herein, in its several embodiments, can be used with any known or later-developed blower apparatus including, but not limited to, those of the centrifugal-type, the axial flow-type, the screw-type, the pulse-type, and other types, as well.

Fuel-charged air is pumped through the blower unit in this and other embodiments of the inventive supercharger. However, other arrangements wherein fuel is added to compressed air downstream from the blower are also contemplated, such arrangements being understood to be commonly known in the art.

Timing cover 22 permits access to the engine's points, and to its cam gear therebeneath.

Figure 2:
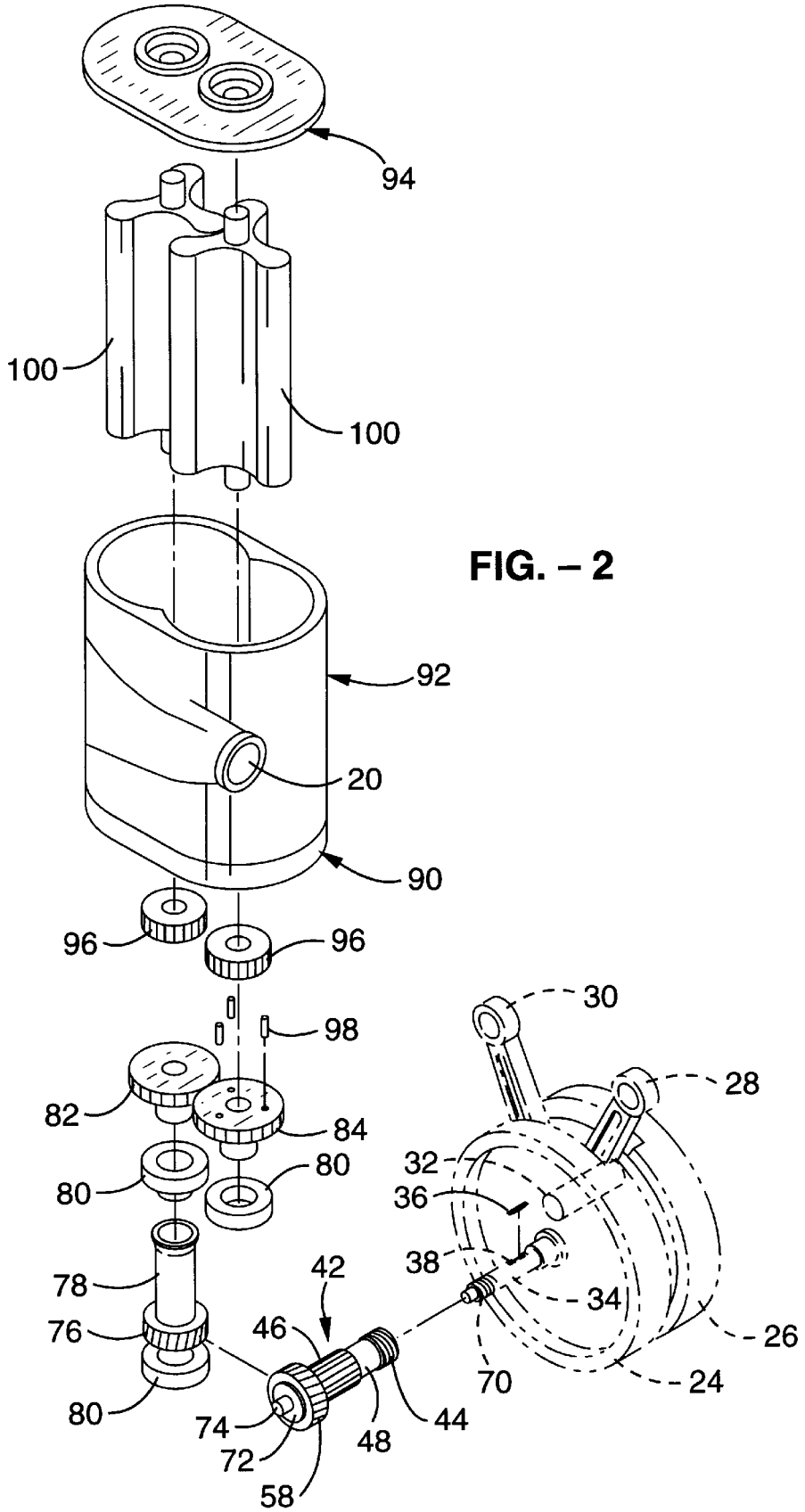
FIG. 2 is an exploded perspective view of the transmission portion of the first embodiment of the invention mated with a Magnuson blower unit.
Figure 3:
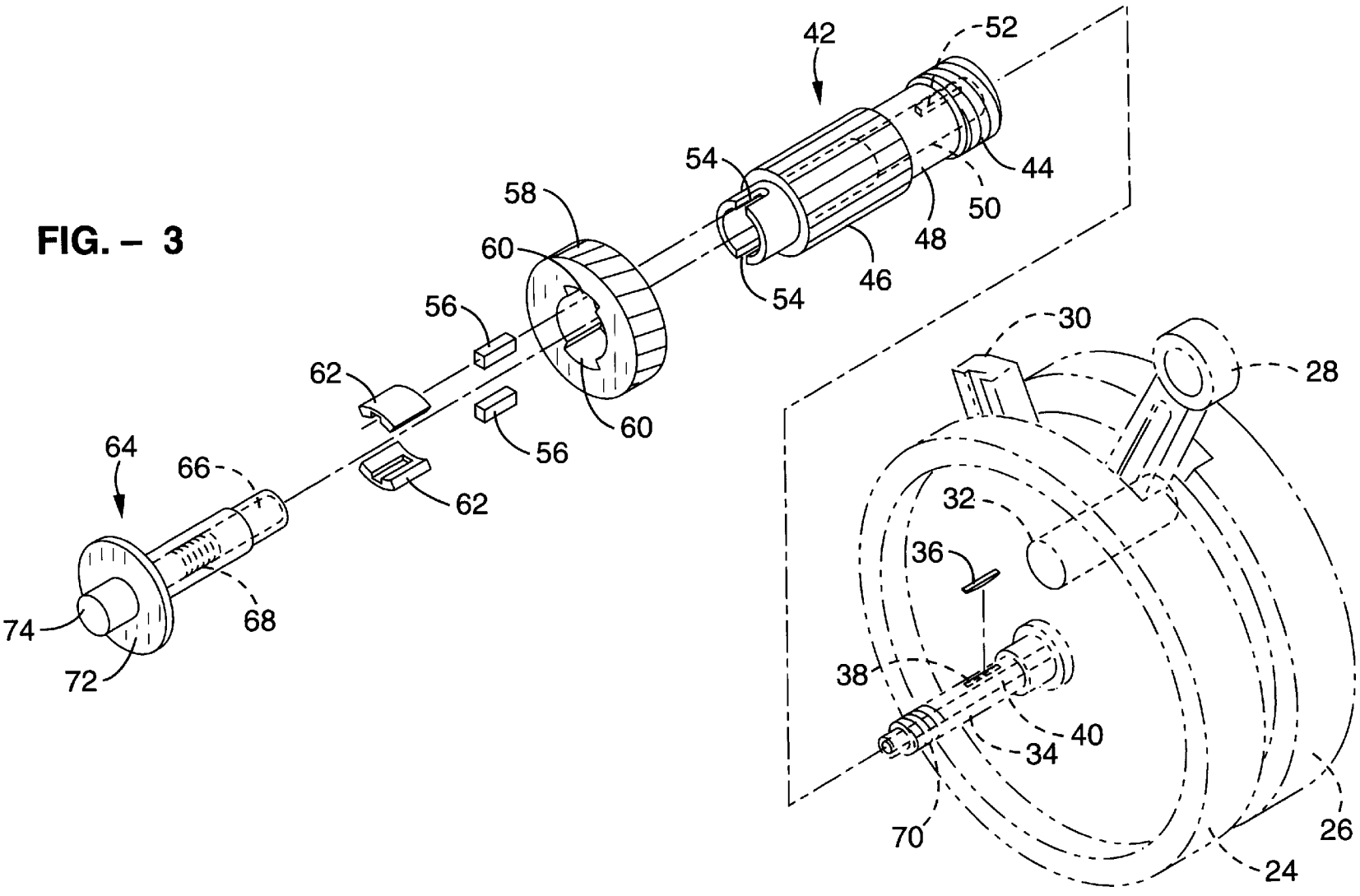
FIG. 3 is an enlarged and further exploded perspective view of the power take-off portion of the first embodiment of the invention.

FIG. 2 shows the internal components, as they exist within transmission housing 12 and blower housing 16, of a first preferred supercharger construction. FIG. 3 shows additional details of the transmission portion of that construction. For orientation, FIGS. 2 and 3 include environmental features such as a Harley-Davidson® engine's right and left flywheels, 24 and 26, respectively. Also shown are upwardly-projecting forward and rearward connecting rods, 28 and 30, respectively, which are affixed to crank pin 32, the right-hand end of crank pin 32 being visible on the face of right flywheel 24. As further shown in FIGS. 2 and 3, a driven shaft projects axially from right flywheel 24, this shaft being generally identified herein as pinion shaft 34.

Pinion shaft 34 is generally cylindrical and includes a mating T-shaped key 36 and key recess 38 to prevent rotation of standard-equipment oil pump drive and cam drive gears (numbered and discussed further below). Pinion shaft 34's cylindrical bore 40 is in fluid communication with the engine's pressurized oil circuit.

Coupling sleeve 42 is comprised of a hollow shaft having two gears cut into its surface. On its proximal end, i.e. that end closest to the engine, sleeve 42 includes an integral oil pump drive gear 44 of the same diameter and tooth pattern as the separate, standard-equipment oil pump drive gear it replaces. That is, oil pump drive gear 44 is a spiral, or worm, gear which engages with a standard-equipment spur gear (not shown) on the end of the engine's standard-equipment oil pump drive shaft (not shown) disposed at a right angle to pinion shaft 34.

Coupling sleeve 42 also includes an integral cam drive pinion gear 46 along the middle of its length. Cam drive pinion gear 46 is of the same diameter and tooth pattern as the separate, standard-equipment cam drive pinion gear it replaces.

Between oil pump drive gear 44 and cam drive pinion gear 46 on sleeve 42, a smooth, spacer portion 48 is provided to substitute for the standard-equipment spacer (not shown) which normally retains the engine's standard oil pump and cam drive gears in proper position.

Coupling sleeve 42's bore 50 is dimensioned for sliding receipt of pinion shaft 34 in a telescopic fashion. As shown in FIG. 3, a short key way 52 is provided in the proximal end of coupling sleeve 42's bore to mate with T-key 36. This prevents coupling sleeve 42 from rotating with respect to pinion shaft 34. Other known rotation-prevention elements may work equally well for this purpose.

Figure 4:
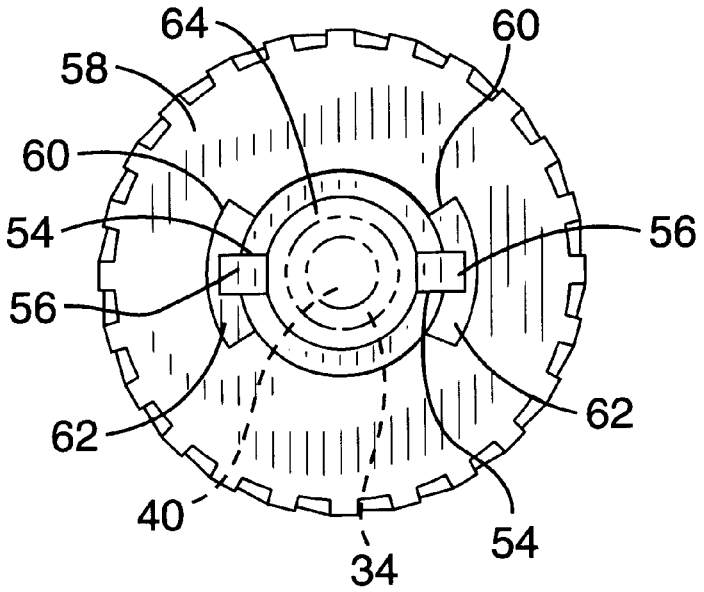
FIG. 4 is a cross-sectional view through the assembled power take-off portion of FIG. 3.

As shown in FIG. 3, the distal end of coupling sleeve 42, i.e. that end farthest from the engine, includes a pair of opposed, longitudinal channels 54 cut through from sleeve 42's surface to its bore 50. Channels 54 are dimensioned for snug receipt of keys 56, keys 56, in turn, being dimensioned to protrude a short distance beyond the outer surface of sleeve 42. This is best shown in FIG. 4.

The distal end of coupling sleeve 42 is fitted with a helical drive gear 58. A pair of opposed extra-wide channels 60 are machined into drive gear 58's inside, annular surface, channels 60 being disposed so as to receive the protruding edges of keys 56 when drive gear 58 is in place on the distal end of coupling sleeve 42. Each interior channel 60 in helical drive gear 58 is preferably about three times the width of a key 56. Thus, when keys 56 are snugly in place in channels 54 and projecting into wider channels 60, this permits drive gear 58 and coupling sleeve 42 to rotate back and forth through a few degrees of arc with respect to one another. The spaces in channels 60 flanking, and not occupied by, the edges of keys 56 are filled with high-density, resilient urethane 62. Other durable, resilient materials able to resist degradation upon exposure to petroleum distillates such as engine oil may also be satisfactory for this purpose.

Coupling sleeve 42 and drive gear 58 are held in place on pinion shaft 34 with cylindrical lock nut 64. Lock nut 64 has a primary outer diameter dimensioned for telescopically sliding receipt by coupling sleeve 42's bore 50. Lock nut 64's bore 66, in turn, receives the distal end of pinion shaft 34, and screw threads 68 in lock nut 64's bore 66 mate with screw threads 70 on pinion shaft 34's distal end to secure lock nut 64 in place. Lock nut 64 further includes a wide, annular collar 72 dimensioned and adapted to hold keys 56 and urethane 62 in place in channels 54 and 60. To permit lock nut 64 to be turned and tightened, lock nut 64's distal, cylindrical head 74 may be provided with holes or slots (not shown) for the purpose of receiving a spanner. Cylindrical head 74 is received within a bushing in transmission housing 12.

Helical drive gear 58 and coupling sleeve 42 serve as a power take-off for coupling a supercharger's transmission to a driven shaft of an engine. And, the interaction of embedded keys 56 with urethane filled channels 60 permits drive gear 58 and coupling sleeve 42 to serve as effective torsion dampening means in transmitting an engine's power to a supercharger.

In normal use, pinion shaft 34 and coupling sleeve 42 extend horizontally, and helical drive gear 58 rotates in a vertical plane. Helical drive gear 58 is engaged with a horizontally-disposed, second helical gear 76 which, in turn, is mounted on vertically-oriented drive shaft 78. Thus, gears 58 and 76 operate at right angles to one another, as do coupling sleeve 42 and drive shaft 78.

To achieve increased torsion dampening in the supercharger's transmission portion, it is preferred that second helical gear 76 be configured as helical drive gear 58 and mounted on vertical drive shaft 78 in a manner similar to that disclosed above regarding gear 58 and coupling sleeve 42.

A support bearing 80 is disposed beneath vertical drive shaft 78, support bearing 80, in turn, being supported by an appropriate support structure (not shown) protruding from the inner wall of transmission housing 12 for that purpose.

Drive shaft 78 is axially coupled to a first of two engaged output ratio selection gears 82 and 84, respectively. Gears 82 and 84 are spur gears, and they rotate in a horizontal plane. Further, each gear 82 and 84 is supported by a bearing 80, each support bearing 80 being, in turn, supported within transmission housing 12 in a known manner.

Figure 5:
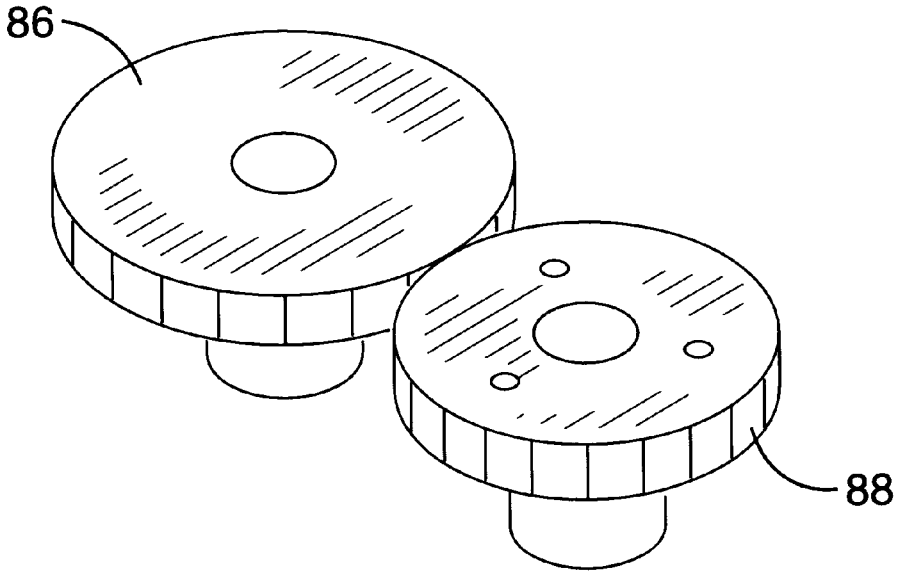
FIG. 5 is a perspective view of an alternative set of output ratio selection gears.

In one version of the preferred embodiment, output ratio selection gears 82 and 84 are of the same diameter. In another version, these gears may be of different sizes for the purpose of increasing or decreasing the speed of transmission portion 12's rotational output, and therefore the efficiency of air compression achieved in the blower unit. For example, as shown in FIG. 5, first alternative output ratio selection gear 86 has a larger diameter than second gear 88; thus, second gear 88 might rotate at a ratio of 1.3:1 or so, with respect to first gear 86. Such increased supercharger transmission output speeds may be desired or necessary for achieving the desired performance in larger-displacement engines.

In the preferred embodiments of the invention, the blower housing 16 is relatively easily removed from the transmission housing 12, thereby exposing gears 82 and 84 and permitting easy replacement thereof with gears of different ratios.

As shown in FIG. 2, a blower housing is generally comprised of a lower cover assembly 90, a primary housing assembly 92, and an upper housing assembly 94. The blower housing shown in FIG. 2 is of an alternative type to the Eaton blower of FIG. 1, that shown in FIG. 2 being the Magnuson blower manufactured and distributed by Magna-Charger. But, as suggested above, these and other types are expected to be equally easily mated with the supercharger transmissions disclosed herein.

In linking the transmission and blower portions of the supercharger, the transmission portion is normally coupled to one of the blower portion's timing gears 96. Any known, secure coupling means may suffice. For example, drive pins 98 may axially link second output selection gear 84 (or alternative second gear 88) to a timing gear, as shown in FIG. 2.

Rotational input to a blower timing gear 96 is transmitted to the mating timing gear, and so to the meshing, air-compressing rotors 100 of the blower unit. Air and fuel drawn in through intake 20 and compressed by rotors 94 is delivered to the engine's intake manifold (not shown) through a port in the blower housing (not shown).

Figure 6:
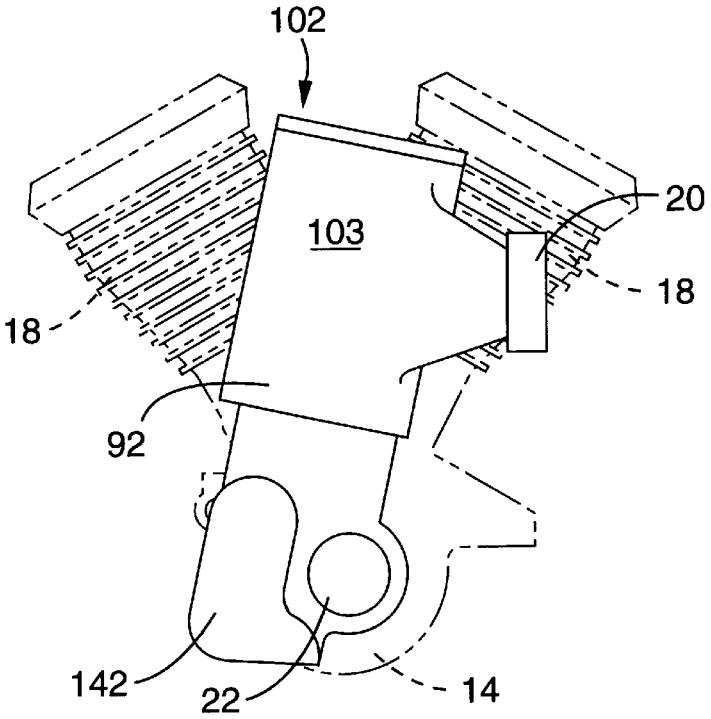
FIG. 6 is a side elevational view of a second embodiment of the supercharging apparatus of the invention, the transmission portion therein being mated with a Magnuson blower unit.
Figure 7:
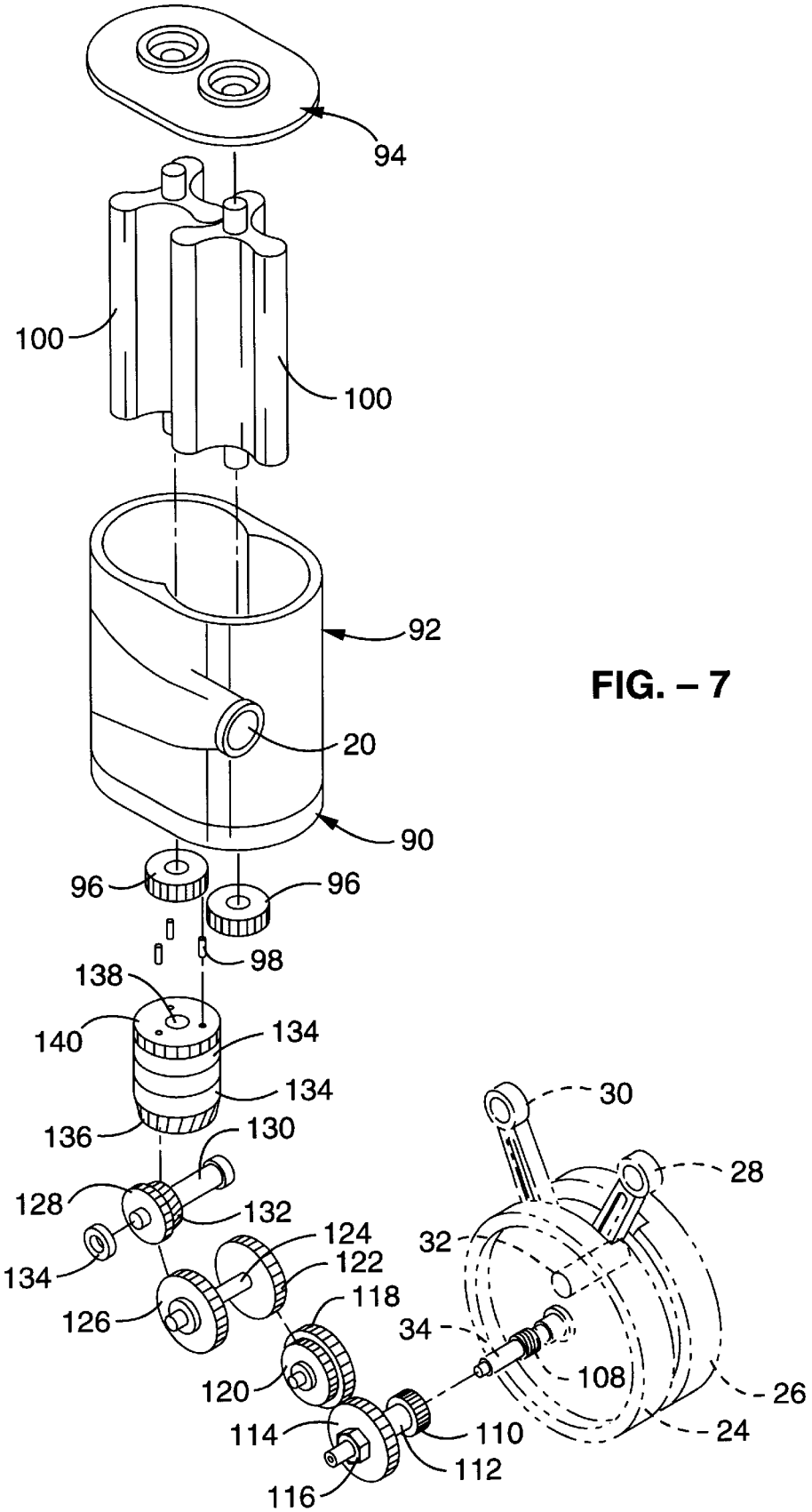
FIG. 7 is an exploded perspective view of a second embodiment of the supercharger of the invention, showing an alternative transmission construction.
Figure 8:
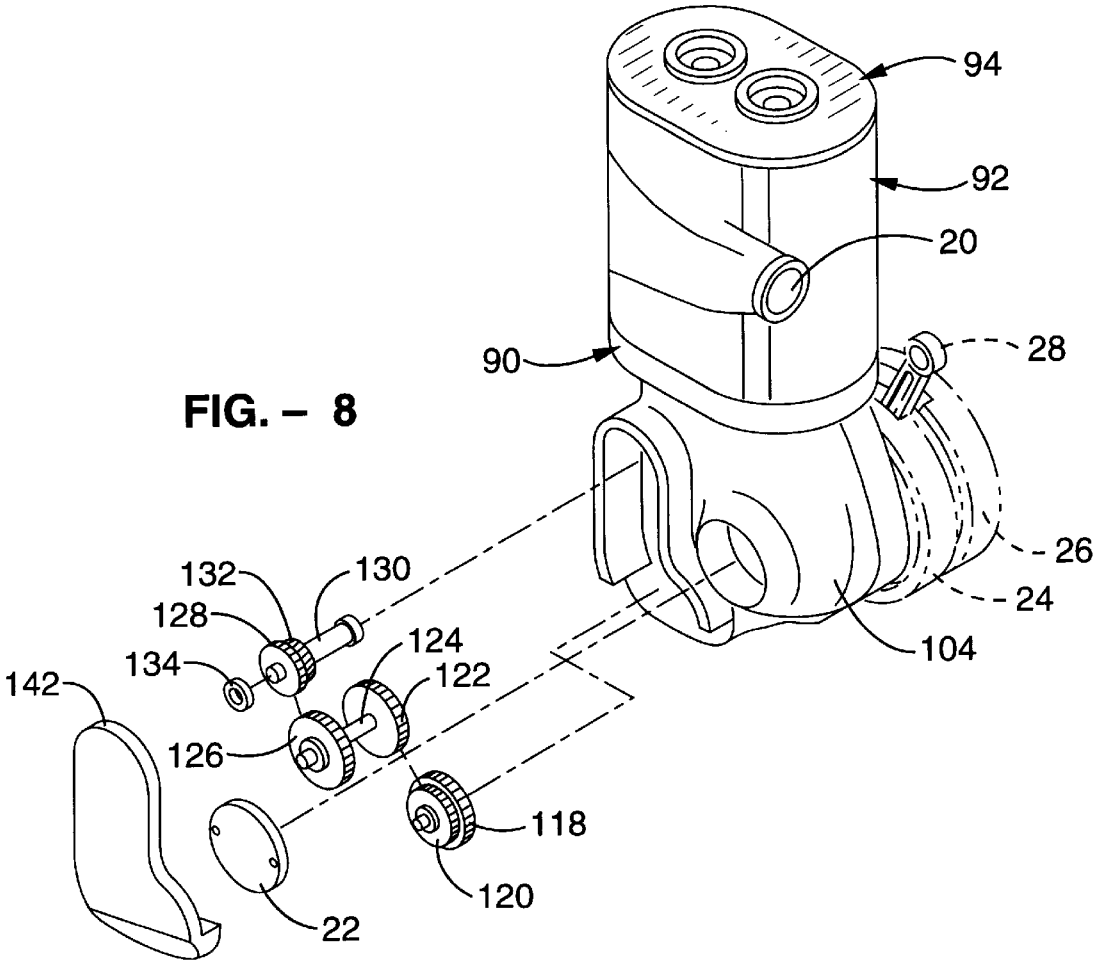
FIG. 8 is an exploded perspective view of the transmission housing of the second embodiment of the invention, showing the gear set accessible beneath its gear set cover.

FIGS. 6, 7 and 8 show a second embodiment 102 of the invention, which includes a transmission comprised of a spur gear train. FIG. 6 illustrates the mounting orientation and general environment of supercharger 102 installed on the right side of a Harley-Davidson® V-twin motorcycle engine. Therein, and in FIG. 8, the supercharger's transmission housing 104 is shown mated with the engine's crank case 14, replacing its standard-equipment side cover (not shown). And, the supercharger's blower housing is shown atop transmission housing 104, positioned generally between cylinders 18. Supercharger 102 is shown here fitted with a Magnuson blower 103, but it should be understood that an Eaton blower 21 such as that shown in FIG. 1, or a blower of another brand or design, may work satisfactorily. As above, the blower's intake 20 may be coupled to any common atomized fuel delivery apparatus. Blower 103's output (not shown) is on its inside face, between cylinders 18, and is coupled with the engine's intake manifold (not shown).

Supercharger 102 does not require replacement of the engine's standard-equipment, oil pump drive worm gear 108; it stays in place on pinion shaft 34. The engine's standard-equipment cam drive pinion gear 110 is mounted on pinion shaft extension 112 which has a proximal, inside-threaded end adapted to mate with pinion shaft 34's distal screw threads 70. Pinion shaft extension 112, in turn, has supercharger drive spur gear 114 affixed to its distal end and secured thereupon with lock nut 116.

A spur gear 118, laterally engaged with supercharger drive spur gear 114 transmits rotation from drive spur gear 114 to a spur gear 120 of smaller diameter, which is axially aligned and mated flush with the face with spur gear 118.

Smaller spur gear 120 is, in turn, laterally engaged with a spur gear 122 mounted on the proximal end of first intermediate drive shaft 124. A spur gear 126 of the same diameter as spur gear 122 is mounted on the distal end of first intermediate drive shaft 124. First intermediate drive shaft 124's distal spur gear 126 is laterally engaged with a smaller spur gear 128 mounted on support shaft 130. Spur gear 128 is axially aligned and mated with the larger diameter face of first bevel gear 132, which is also mounted on support shaft 128.

First intermediate drive shaft 124 and support shaft 128 are parallel with one another, and are supported within transmission housing 104 upon bearings 134, and the like, as is well known in the art. Spur gears 114, 118, 120, 122, 126 and 128, and bevel gear 130, all rotate in parallel planes.

Second bevel gear 136 is perpendicularly engaged with first bevel gear 132, and is mounted on a vertically oriented second intermediate drive shaft 138. Vertical drive shaft 138 drives horizontally-disposed output drive disc 140. Drive pins 98 couple drive disc 140 to one of the timing gears 96 of the blower unit.

As shown in FIG. 8, transmission housing 104 of second embodiment 102 is provided with gear train cover 142 to permit easy access to the gear train therewithin. Timing cover 22, which yields access to the points, is similar to the standard-equipment unit used in this and other embodiments.

Figure 9:
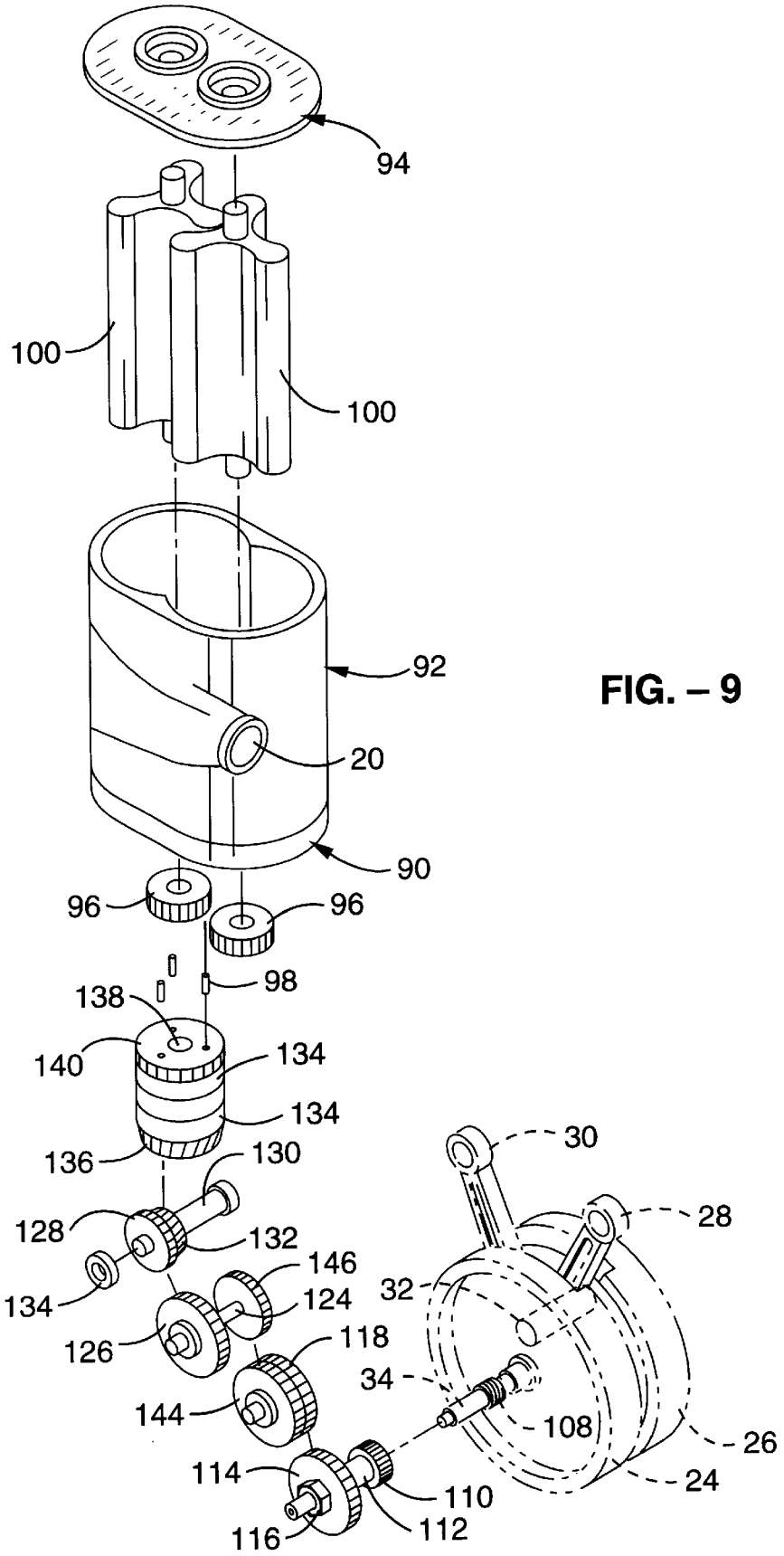
FIG. 9 is an exploded perspective view of the second embodiment of the supercharger of the invention, showing an alternative quick-change gear set having a different gear ratio.

The design of the transmission gear train of second supercharger embodiment 102, as well as its transmission housing 104 and gear train cover 142, permits use of a quick-change gear set for changing the gear ratio, and therefore the output speed, of the transmission portion of the supercharger. As shown in FIG. 9, in comparison with FIG. 7, spur gear 120, and spur gear 122 on first intermediate drive shaft 124, may be exchanged with higher ratio gears 144 and 146 respectively, to achieve higher performance.

Figure 10:
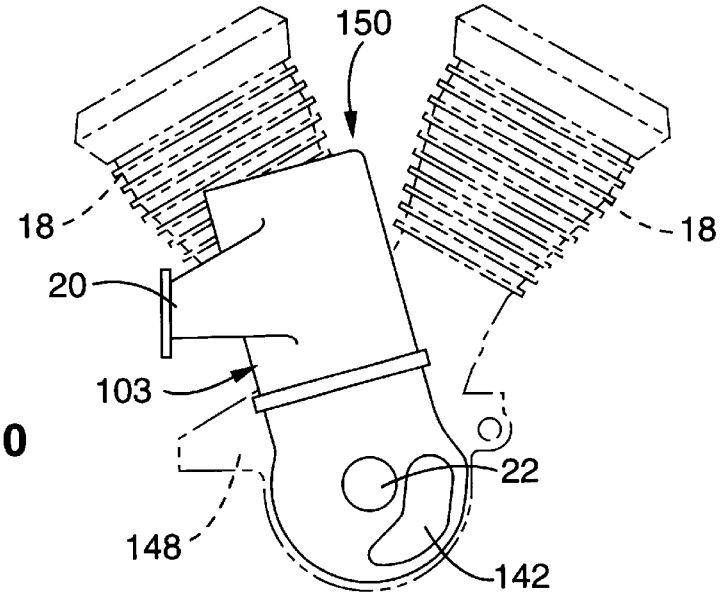
FIG. 10 is a side elevational view of an alternative, left-side mounting option for the supercharging apparatus of the invention.

It should also be understood that either of the preferred supercharger embodiments of the invention, or variations thereof, may be mounted on the primary drive side 148, i.e. the left side, of a Harley-Davidson® motorcycle's engine by simply coupling the power take-off drive gear to the splined drive shaft which projects from that side of the engine. Such an embodiment is shown in FIG. 10, and is generally identified therein with reference numeral 150. A Magnuson blower unit 103 is depicted therein for example.

It is also contemplated that additional torsion dampening means may be used in the blower drive input portion of any embodiment of the invention. Such additional torsion dampening means may conveniently be of the type shown in U.S. Pat. No. 4,844,044 issued to McGovern in the name of Eaton Corporation in 1989.

It should be understood that the aforedescribed gears, bearings and other components of the invention's preferred embodiments may be lubricated by providing them with channels and ports in fluid communication with the engine's pressurized oil circuit; such channels and ports, for example, being in communication with that portion of the oil circuit which runs through bore 40 of pinion shaft 34.

The foregoing detailed disclosure of the inventive supercharger in its several embodiments is considered as only illustrative of the preferred embodiment of, and not a limitation upon the scope of, the invention. Those skilled in the art will envision many other possible variations of the structure disclosed herein that nevertheless fall within the scope of the following claims. For example, many known means for selective on/off control of the delivery of compressed air from a supercharger to an engine's intake manifold are known, and all could be utilized in the practice of this invention. In addition, known, specialized features which operate in the case of backfire and other anomalous situations might also be employed. Yet further, in all places where bevel, helical or spiral/worm gears are used to achieve right-angled transmission of rotation, slight modifications will permit each of these to be used in place of the others. Thus, although specific, preferred drive train configurations are disclosed and claimed herein, the right-angled portions thereof should be considered essentially interchangeable.

Moreover, the elements disclosed herein may be utilized as a kit, and therefore constitute inventive subcombinations and combinations separate and apart from the particular apparatus to which they are intended to be applied, and aside from the environment in which they are adapted to be used.

And, alternative uses for this inventive supercharger may later be realized. For example, this supercharger may find broad application in the automotive arts, and may also be useful in non-automotive applications where internal combustion engines are used as a power source. Indeed, the embodiments disclosed, perhaps with small modifications, could be applied to any engine with an available power take-off close to the fuel intake manifold system.

Accordingly, the scope of the invention should be determined with reference to the appended claims, and not by the examples which have herein been given.

I claim:

1. Apparatus for adding a torsion dampened power take-off gear to the distal end of a driven shaft of an internal combustion engine, said apparatus comprising:

a. a coupling sleeve dimensioned for sliding coaxial receipt of said driven shaft's distal end, said coupling sleeve having proximal and distal ends;

b. means for preventing said coupling sleeve from rotating with respect to said shaft;

c. a longitudinal channel in said coupling sleeve's outer surface at said coupling sleeve's distal end;

d. a gear slidingly and coaxially disposed upon said coupling sleeve's distal end;

e. a channel in said gear's interior annular surface, said gear's channel being aligned with said coupling sleeve's channel thereby defining a key way, said gear's channel being substantially wider than said coupling sleeve's channel;

f. a key in said key way, said key being dimensioned so as to be snugly received in said coupling sleeve's channel, but very loosely received in said gear's channel;

g. a dense, resilient material in said gear's channel, said dense, resilient material filling all space in said gear's channel not occupied by said key;

h. means for locking said gear and coupling sleeve to said driven shaft's distal end.

2. The apparatus of claim 1, wherein said gear locking means comprises a locking sleeve, said locking sleeve being slidingly and coaxially received within said coupling sleeve's bore and, at once, being coaxially received upon said driven shaft's distal end, said locking sleeve further including interior screw threads engaged with mating screw threads on said driven shaft adjacent said driven shaft's distal end.

3. The apparatus of claim 2, wherein said locking sleeve further comprises an annular collar covering said key way's distal end.

* * * * *